US009732484B2

(12) United States Patent
Rohde et al.

(10) Patent No.: US 9,732,484 B2
(45) Date of Patent: Aug. 15, 2017

(54) ENERGY ABSORBING GUARDRAIL SYSTEM

(71) Applicant: Safety By Design, Inc., Lincoln, NE (US)

(72) Inventors: John R. Rohde, Steamboat Springs, CO (US); John D. Reid, Lincoln, NE (US); King K. Mak, San Antonio, TX (US); Dean L. Sicking, Indian Springs, AL (US)

( * ) Notice: Subject to any disclaimer, the term of this patent is extended or adjusted under 35 U.S.C. 154(b) by 150 days.

(21) Appl. No.: 14/414,644

(22) PCT Filed: Jul. 21, 2014

(86) PCT No.: PCT/US2014/047361
§ 371 (c)(1),
(2) Date: Jan. 13, 2015

(87) PCT Pub. No.: WO2016/014013
PCT Pub. Date: Jan. 28, 2016

(65) Prior Publication Data

US 2016/0265177 A1 Sep. 15, 2016

(51) Int. Cl.
*E01F 15/04* (2006.01)
*E01F 15/14* (2006.01)

(52) U.S. Cl.
CPC ..... *E01F 15/0438* (2013.01); *E01F 15/043* (2013.01); *E01F 15/0492* (2013.01); *E01F 15/143* (2013.01)

(58) Field of Classification Search
CPC .. Y10S 256/05; Y10T 403/11; E01F 15/0438; E01F 15/043; E01F 15/0492; E01F 15/143; E01F 15/04; E01F 15/02; E01F 15/0415; E01F 15/0423
USPC ..... 256/13.1; 404/6
See application file for complete search history.

(56) References Cited

U.S. PATENT DOCUMENTS 5,775,675 A * 7/1998 Sicking ..... E01F 15/0476 256/13.1
5,797,591 A * 8/1998 Krage ..... E01F 15/143 256/1
5,957,435 A * 9/1999 Bronstad ..... E01F 15/143 256/13.1
6,902,150 B2 * 6/2005 Alberson ..... E01F 15/143 256/13.1
7,147,088 B2 * 12/2006 Reid ..... F16F 7/125 188/374
8,448,913 B1 * 5/2013 Rohde ..... E01F 15/04 248/548
2001/0013596 A1 * 8/2001 Sicking ..... E01F 15/143 256/13.1
2003/0015695 A1 * 1/2003 Alberson ..... E01F 15/0461 256/13.1

(Continued)

*Primary Examiner* — Jonathan Masinick

(57) ABSTRACT

A highway crash attenuation system having W-beam rail elements attached to a plurality of vertical posts. An impact terminal with a feeder chute guides one or more of the W-beam rail elements through the impact terminal. The feeder chute has an impact shield extending along a traffic-facing side of the chute from an upstream-most end to a downstream-most end of the chute closing the traffic-facing side of the chute. The system also has an anchor cable release mechanism for releasing the cable downstream of the first vertical post and an improved first breakaway post.

7 Claims, 19 Drawing Sheets

(56) References Cited

U.S. PATENT DOCUMENTS

| | | | | |
|---|---|---|---|---|
| 2003/0151038 | A1* | 8/2003 | Alberson | E01F 15/143<br>256/13.1 |
| 2003/0213946 | A1* | 11/2003 | Alberson | E01F 15/06<br>256/13.1 |
| 2007/0063178 | A1* | 3/2007 | Alberson | E01F 15/0453<br>256/13.1 |
| 2007/0063179 | A1* | 3/2007 | Alberson | E01F 15/0453<br>256/13.1 |
| 2007/0215849 | A1* | 9/2007 | Alberson | E01F 15/0423<br>256/13.1 |
| 2012/0056143 | A1* | 3/2012 | James | E01F 15/06<br>256/13.1 |

* cited by examiner

ENERGY ABSORBING GUARDRAIL SYSTEM

BACKGROUND

The present invention relates to improvements to energy absorbing guardrail systems having end terminals, anchor cable release mechanisms, and breakaway posts used in cooperation with longitudinal, W-beam guardrail sectional barriers. These systems usually extend along highways and roadsides to absorb impact energy and deflect vehicles from hazards which may be associated behind the barriers. The present invention more specifically relates to systems having sequential kinking terminals (SKT) and flared energy absorbing terminals (FLEAT). More particularly, the present invention relates to an improved feed chute shield for the terminal; improved quick anchor cable release mechanisms; an improved breakaway post (Post 1) which facilitates breakaway in head-on impacts while resisting loads on side impacts; and an improved anchorage system that maintains tension in the W-beam rail after initial release of tension due to cable anchor release in order to reduce the propensity for the W-beam rail to buckle and form an elbow that may pose a hazard to the impacting vehicle. Each of these improvements may be incorporated into existing energy absorbing guardrail systems, alone or in combination, to improve the overall safety performance of the systems.

Impact heads of existing SKT, FLEAT, and other energy absorbing terminals do not have a shield to protect traffic-side exposure to the W-beam rail guide tube or feeder chute. For angled impacts in the area of the feeder chute, an impacting vehicle may potentially wedge into the opening of the existing prior art feeder chute. Such wedging may possibly cause the impacting vehicle to get hung up, thus, preventing smooth redirection of the vehicle. Wedging also may potentially snag vehicle parts in situations where it should be an easy gate-through. Such wedging, in turn, could lead to rollover of the impacting vehicle. Further, in the existing prior art feeder chute, the W-beam rail may buckle out of the traffic-side of the chute as the impact terminal head and the feeder chute are urged downstream by the impacting vehicle. When such buckling occurs the entire energy absorption process may stop.

An embodiment of the present invention provides a shield plate extending along the traffic-side of the chute substantially the entire length of the chute. This shield plate closes the traffic-side of the feeder chute and prevents impacting vehicles from wedging into the feeder chute. The closing shield also prevents the W-beam rail from buckling out the traffic-side of the chute as it is urged downstream along the W-beam rail element.

Existing SKT and FLEAT terminals depend on the break away of Post 1 to release the upstream end of an anchor cable. However, under certain impact conditions, Post 1 may not break away properly, thus not releasing the anchor cable. This in turn may result in snagging and excessively high deceleration of the impacting vehicle.

An embodiment of the present invention provides for the release of the anchor cable at the downstream end (i.e., at the anchor release bracket) rather than relying on the breaking away of Post 1 to release the upstream end of the anchor cable. The improved anchor cable release mechanism includes a release arm attached to the anchor cable release bracket with a pivot bolt and alignment shear pins to release the anchor cable at the downstream end of the cable.

In another embodiment, a plurality of the improved anchor cable release brackets may be mounted to downstream sections of the guardrail with additional cable lengths swagged together to span from Post 1, through the first anchor release bracket, to the subsequent downstream anchor brackets. The upstream end of the anchor cable is attached permanently to Post 1. While the present disclosure discusses a system with two such anchor cable release brackets, it should be understood that more such brackets may be utilized to maintain tension in the W-beam rail element as the impact head is urged downstream on impact.

In a typical end-on impact with a single anchor cable release bracket, once the impacting vehicle pushes the impact head downstream, breaking away Post 1, and releasing the anchor cable from the first anchor cable release bracket and pushing the first release bracket off the W-beam rail, the tension in the W-beam rail is released. With the two (or more) anchor release bracket embodiment of the present invention, after the anchor cable is released from the first anchor bracket and the first bracket is pushed off the W-beam rail, the tension in the W-beam rail is maintained by the second (or other) anchor cable release brackets. The rail tension maintained through the release of subsequent brackets reduces the propensity for the W-beam rail to buckle and form an elbow that may pose a hazard to the impacting vehicle. Thus, the rail tension is maintained until the impact head releases the subsequent anchor brackets and releases the downstream-most end of the anchor cable.

In an embodiment of the present invention, a supplemental anchor cable mechanism is provided to maintain tension in the W-beam rail after release of the primary anchor cable. The supplemental anchor cable system is designed to reduce the propensity of the W-beam rail to buckle in end-on impact at an angle.

An additional and separate anchor for the supplemental anchor cable mechanism may be installed upstream of the impact head. In yet another embodiment, this supplemental mechanism is incorporated into the Post 1 anchor as will be described below. The supplemental anchor cable may be attached to the additional anchor at its upstream end, extend through the impact head, and may be retained by a bracket attached to an upstream end of the W-beam rail. Sufficient slack is provided in the supplemental anchor cable length so that the supplemental cable is not tensioned until it becomes taut.

Testing of end-on impacts shows that after the primary anchor cable is released from the cable anchor release mechanism, tension in the W-beam rail is released until the supplemental anchor cable becomes taut. At that point, tension in the W-beam rail is re-established by the supplemental anchor cable system.

A feature of the prior art Post 1 design is that Post 1 is intended to breakaway when the post is impacted from a head-on direction, but the post has limited lateral strength. Thus, for side impacts just downstream of Post 1, the prior art Post 1 design may unintentionally break away allowing the impacting vehicle to gate through the terminal and go behind the guardrail installation. An embodiment of the present invention provides for an improved post design that still allows Post 1 to break away in head-on impact, while providing added lateral strength to accommodate side impacts just downstream of Post 1.

BRIEF DESCRIPTION OF THE DRAWINGS

FIG. 7A shows the mechanism before vehicular impact. FIG. 7B shows the feeder chute engaging the sloped section of the release arm. FIG. 7C shows the arm fully pivoted and the anchor cable released. FIG. 7D shows the anchor bracket impact shoulder engaging and releasing the bracket from the W-beam rail.

FIGS. 7A'-7D' illustrates details of portions of FIGS. 7A-7D.

FIG. 8A shows the mechanism before vehicular impact. FIG. 8B shows the cable release strut on the downstream end of the feeder chute engaging the sloped section of the release arm. FIG. 8C shows the arm pivoting as it releases the end of the cable (cable not shown for clarification purposes). FIG. 8D shows the bracket release shoulder engaging and releasing the bracket from the W-beam rail element.

FIG. 13A shows the initial position prior to impact. FIG. 13B shows the upper section rotating or pivoting in a downstream direction with the upper section lip pivoting about the lower section strut. FIG. 13C shows the upper section disengaging from the lower section.

FIGS. 14A-14D correspond equivalently to FIGS. 13A-13C.

DETAILED DESCRIPTION

Figure 1A:
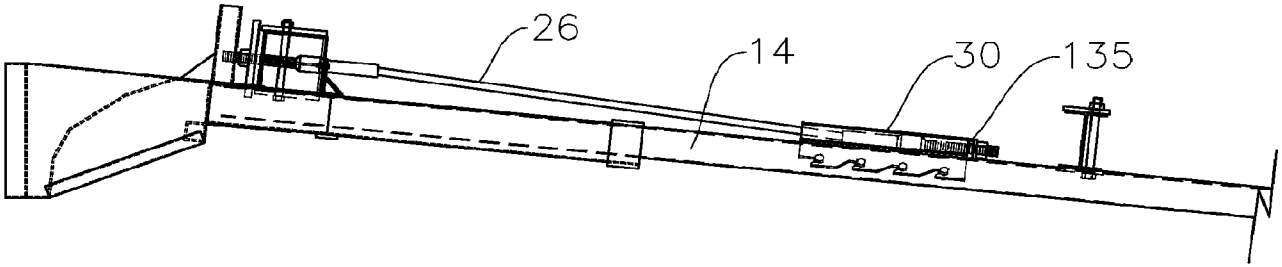
Fig. 1A PRIOR ART
FIG. 1A shows a top view of the prior art highway guardrail system of FIG. 1.
Figure 1:
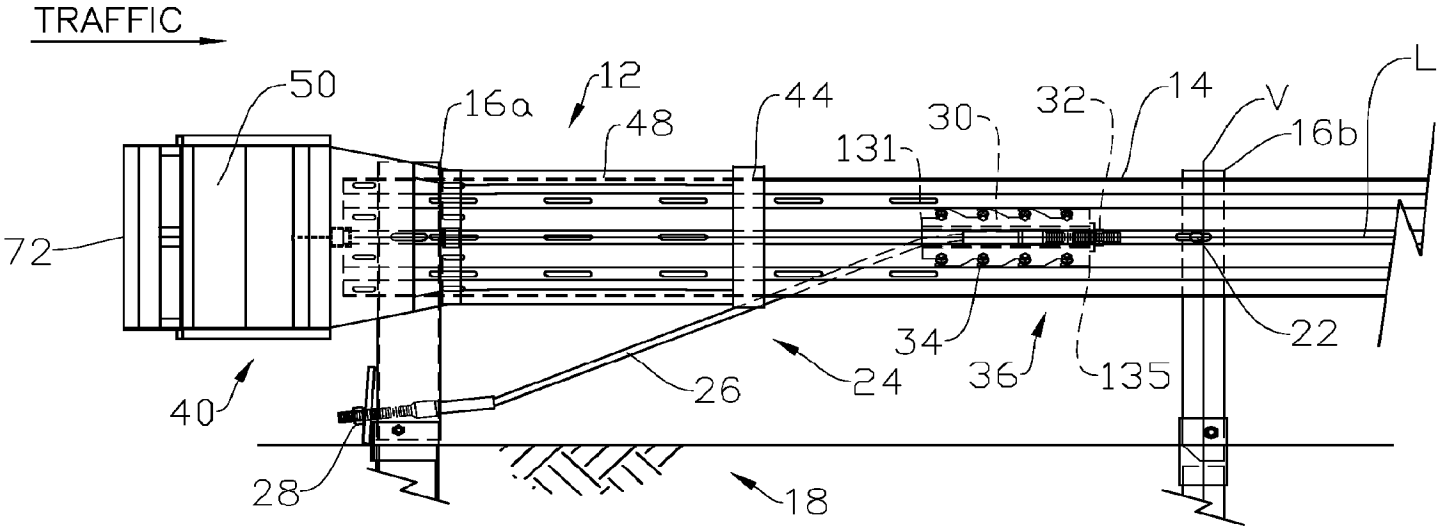
Fig. 1 PRIOR ART
FIG. 1 illustrates a side elevation view of a prior art highway guardrail system.

Referring now to the drawings, and more particularly to FIG. 1 which shows prior art, the reference numerical 12 generally represents an energy dissipating guardrail terminal. The terminal is adapted to be connected to the upstream side of a conventional guardrail 14 consisting of standard W-beam guardrail sections. The guardrail sections or rail elements are attached along their vertical axes V by bolts 22 to a plurality of spaced apart vertical breakaway posts 16*a*-16*b*. Any suitable number of posts may be used depending upon the expanse of the guardrail run. FIG. 1 illustrates two steel breakaway posts. Steel posts downstream from lead posts 16*a* and 16*b* may be embedded directly into the soil 18.

FIG. 1 further illustrates the anchor cable mechanism 24 of the prior art (see U.S. Pat. No. 8,448,913 which is incorporated herein for all purposes) which includes an anchor cable 26, a lower anchor cable bolt 28, an anchor cable release bracket 30, an upper anchor cable button and cap 32, and eight anchor bracket attachment bolts 34. The anchor cable mechanism is provided to allow the terminal 12 to withstand angular vehicle impacts downstream of its upstream end 36.

It is intended that a vehicle will impact the guardrail 14 downstream of its upstream end 36; however, a collision with the upstream end 36 requires the provision of an end treatment 40 to reduce the extent of injury to the impacting vehicle and its occupants. The purpose of the end treatment is to dissipate impact energy of the vehicle. There are a number of existing prior art treatments which are compatible with the instant invention. Including, but not limited to, the sequential kinking terminal (SKT) and the bursting energy terminal (BEAT).

As seen in these prior art figures, the impact head portion 50 of the end treatment 40 is attached on the upstream end of a guide tube or feeder chute 48. Guide tube 48 is mounted onto lead post 16*a* by fasteners passing through post angle brackets. The upstream end of the W-beam rail element 14 extends into the guide tube 48. Guide tube 48 has an anchor bracket impact shoulder 44 with a leading tapered edge which impacts with the upstream end of anchor cable release bracket 30 when the impact head 50 is urged downstream upon a vehicular impact.

When the end treatment 40 is impacted end-on by an errant vehicle, an impact plate 72 will engage and interlock mechanically with the front of the vehicle. As the vehicle proceeds forward, the impact head 50 will be moved forward or downstream along the W-beam rail element 14. Post 16*a* is provided with a hole though which passes the upstream end of the anchor cable 26. When the impact head is displaced downstream in a collision, post 16*a* will snap or break, thus releasing the tension on the cable 26 of the anchor cable mechanism 24 at this upstream location.

At or shortly after breaking the lead post 16*a*, the upstream end of the W-beam rail element 14 will be treated within the impact head to dissipate impact energy. As the vehicle proceeds forward and pushes the impact head 50 along, the downstream end of the guide tube/feeder chute 48 reaches the upstream end of anchor cable release bracket 30 on the rail element 14. The anchor cable release bracket, which is held on the W-beam rail element 14 by the anchor cable release bracket attachment bolts 34, will be pushed forward, slide off the bolts 34, rotate out of parallel alignment with and be released from the W-beam rail element 14. This process is fully described in U.S. Pat. No. 8,448,913.

For impacts that are either end-on at a large angle or near the end of the end treatment 40 (e.g. between lead post 16*a* and cable anchor bracket 30), the impacting vehicle will break off posts 16*a* and/or 16*b*, bend the W-beam rail element, and gate behind the end treatment and guardrail installation.

For impacts into the side of the terminal downstream of the beginning of length-of-need, the terminal 12 will act like a standard guardrail section and will contain and redirect the impacting vehicle. The anchor cable mechanism will provide the necessary anchorage to resist the tensile forces acting on the rail element to contain and redirect the vehicle.

FIG. 1A is a top view of a prior highway guardrail system showing the anchor cable 26 attached to the lower portion of Post 1 and extending to a prior art anchor cable release bracket 30. Details of the structure and operation of the prior art cable release mechanism are taught and disclosed in U.S. Pat. No. 8,448,913 B1 issued May 28, 2013, which disclosure is incorporated herein for all purposes. The bracket 30 moves away from and out of parallel alignment with the W-beam rail element 14 beginning at a downstream end 135 of the prior art mechanism.

Figure 2A:
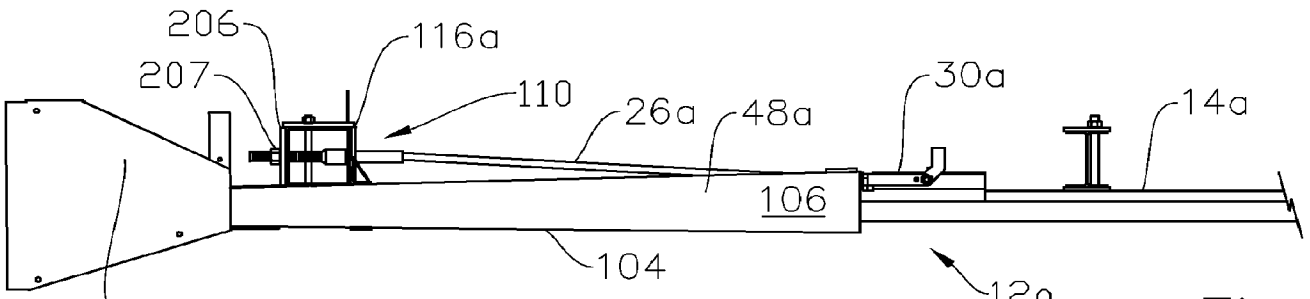
FIG. 2A is a top view of the guardrail system of FIG. 2.
Figure 2:
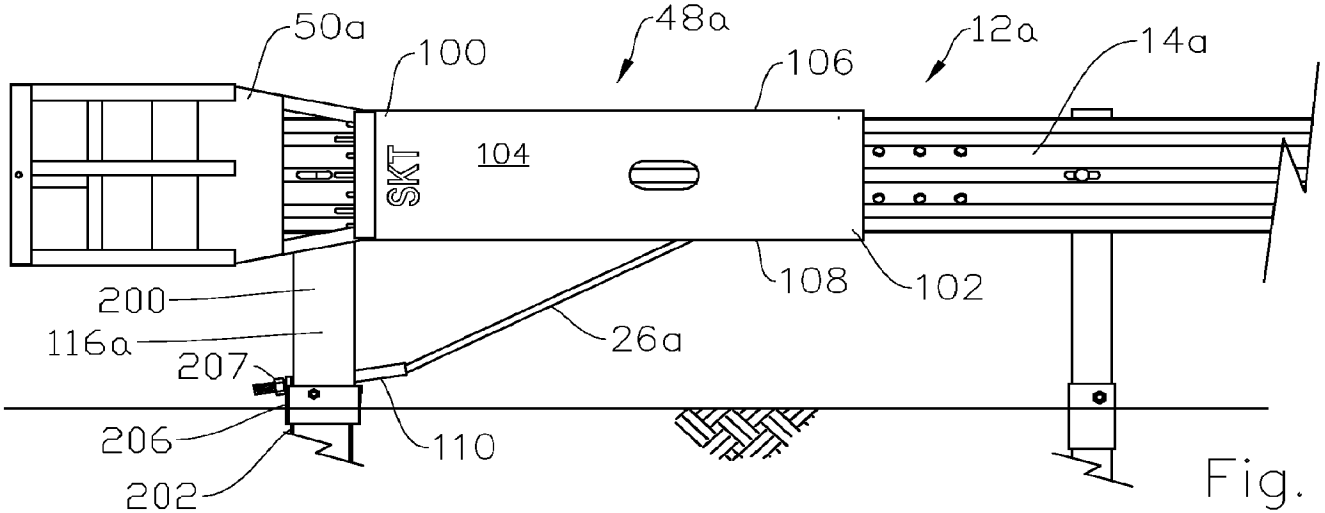
FIG. 2 shows a side elevation view of a sequential kinking terminal of the present invention with a feeder chute shield plate, an improved anchor cable release mechanism attached to a downstream section of a W-beam rail element, and an improved Post 1 design.

Turning now to the present invention, in FIG. 2, a side elevation view of a sequential kinking terminal 12*a* shows an embodiment of an improved guide tube/feeder chute 48*a* having an upstream-most end 100 and a downstream-most end 102. Extending along the traffic-side of the chute 48*a*, substantially the entire length of the chute and from the top of the chute 106 to the bottom of the chute 108 is a shield plate 104. Plate 104 covers this traffic-side of the chute from upstream-most end 100 to downstream-most end 102 and prevents an impacting vehicle from wedging into the feeder chute 48*a* and preventing the W-beam rail element 14*a* from buckling out the traffic-side of the chute 48*a* as terminal impact head 50*a* moves downstream along the W-beam rail element.

FIG. 2A is a top view of the guardrail system of FIG. 2 showing an improved anchor release mechanism 30*a* with an anchor cable 26*a* attached at an upstream end 110 to an improved Post 116*a* and to the improved anchor release mechanism 30*a* at downstream end. The upstream end 110 of cable 26*a* passes through a hole 221 (FIG. 11A) in a front side plate 206 attached to the upstream face of the lower post section 202 of post 116*a*. To retain the cable 26*a* and to keep it from pulling out of hole 221, a locking nut 207 is threadingly attached to the upstream most end of the cable 26*a*. Further details of the improved anchor cable release mechanism are described below.

Figure 3A:
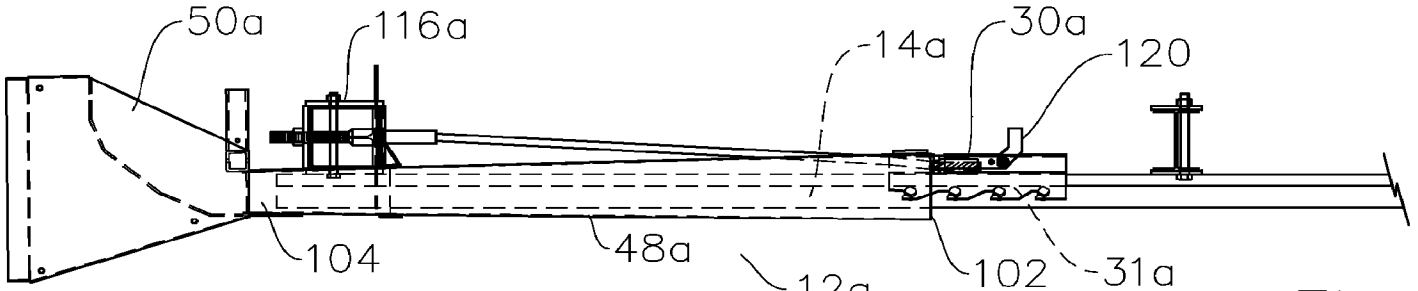
FIG. 3A is a top view of the guardrail system shown in FIG. 3.
Figure 3:
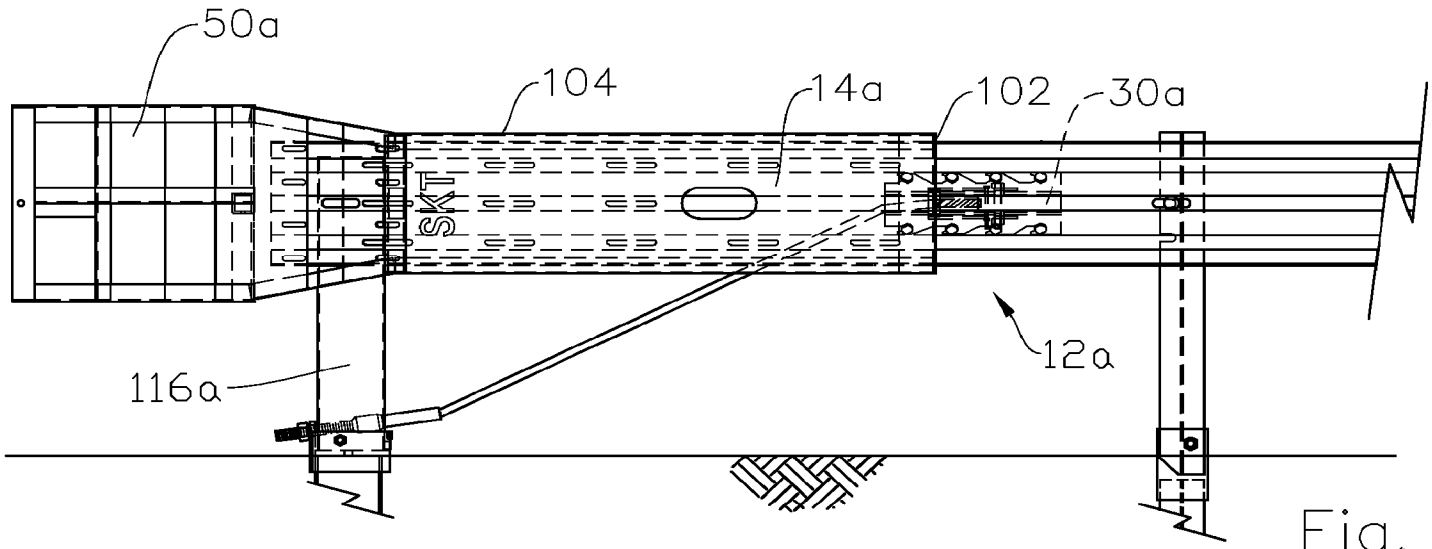
FIG. 3 is an illustration of the guardrail system of FIG. 2 with broken lines to show the improved anchor cable release mechanism and the W-beam rail behind the feeder chute shield plate.

FIG. 3 illustrates the guardrail system of FIG. 2 with broken lines making the improved anchor cable release mechanism 30*a* and the W-beam rail element 14*a* behind the feeder chute shield plate 104 more clearly visible.

FIG. 3A is a top view of the guardrail system of FIG. 3 showing anchor release arm 120 of the release mechanism 30*a* prior to engagement with the downstream end 102 of the chute 48*a*.

Figure 4:
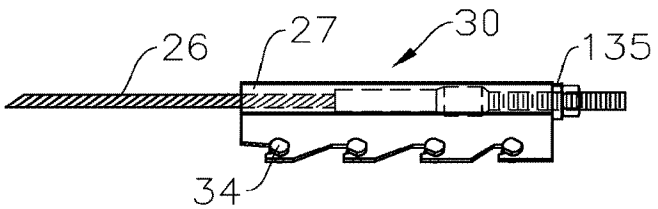
Fig. 4 PRIOR ART
FIG. 4 is an illustration of a prior art anchor cable release bracket showing an anchor cable extending through the anchor cable channel and secured to the downstream end of the bracket.
Figure 5:
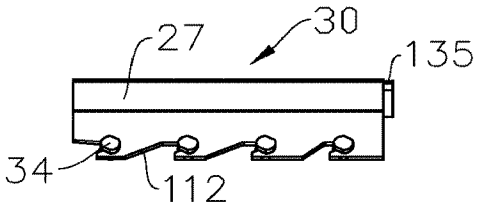
Fig. 5 PRIOR ART
FIG. 5 illustrates the prior art anchor cable release bracket of FIG. 4 without the anchor cable and as it would appear mounted to a W-beam rail element (not shown).

FIGS. 4 and 5 illustrate top views of a prior art anchor cable release bracket 30. Again, the details of the prior art bracket 30 are presented in U.S. Pat. No. 8,448,913 incorporated herein for all purposes. FIG. 4 shows an anchor cable 26 extending through the cable through channel 27 and secured to the downstream end 135 of the bracket.

Figure 4A:
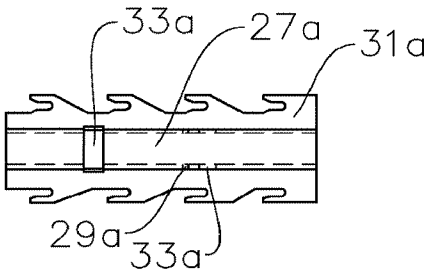
FIG. 4A is a side elevation of the improved anchor cable release bracket of the present invention as it appears when releasably mounted to a W-beam rail element (the W-beam rail element is not shown).
Figure 4B:
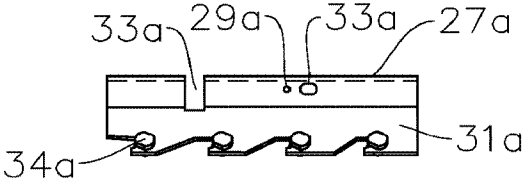
FIG. 4B is a top plan view of the improved anchor cable release bracket of the present invention.

FIG. 5 shows the prior art bracket 30 without the anchor cable but with the mounting bolts 34 in the tapered slots 112 of the bracket 30. Turning to FIGS. 4A-6A details of an improved anchor cable release mechanism 30*a* including the bracket 31*a* and the anchor cable release arm 120 are shown. FIG. 4A is a side elevation view of an improved anchor cable release bracket 31*a*. Bracket 31*a* is similar to the bracket 30 of the prior art, but with several unique design improvements. A yoke slot 33*a*, alignment/retention pin holes 29*a*, and pivot mounting holes 34*a* are provided in the cable through channel 27*a*. The relationship of the elements is shown in the side elevation view of the bracket 31*a* in FIG. 4B as if mounted to a W-beam rail element by mounting bolts 34*a*.

Figure 5A:
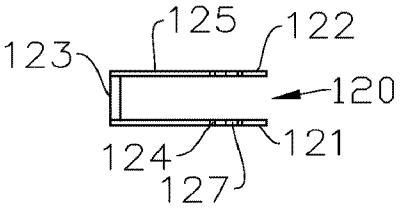
FIG. 5A is a side elevation of the anchor cable release arm of the present invention.
Figure 5B:
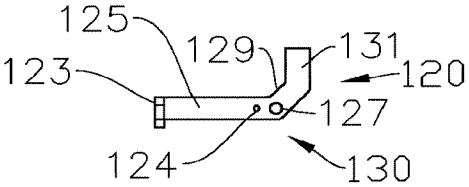
FIG. 5B is a top view of the arm of FIG. 5 showing the vertical and horizontal portions of the arm.

FIG. 5A is a side elevation view of an anchor cable release pivot arm 120 of the anchor cable release mechanism 30*a* of the present invention. FIG. 5B is a top view of the pivot arm 120 of FIG. 5A. As seen in FIG. 5A, the pivot arm 120 has two, spaced-apart, L-shaped sides or straps 121 and 122 welded to a cable release yoke 123 on the long ends 125 of the L-shaped straps. The straps also have through bolt holes 127 and alignment retention pin holes 124. A sloping intermediate section 129 of the straps connects the long end 125 to the horizontal end 131.

Figure 6A:
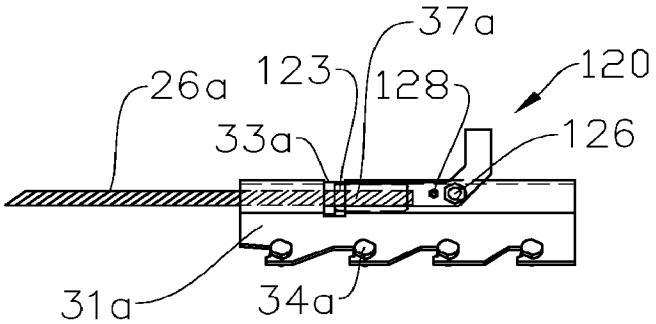
FIG. 6A is a top view of the release mechanism of FIG. 6 with a downstream end of the anchor cable retained in the bracket by the release arm retention yoke releasably securing the cable end.
Figure 6:
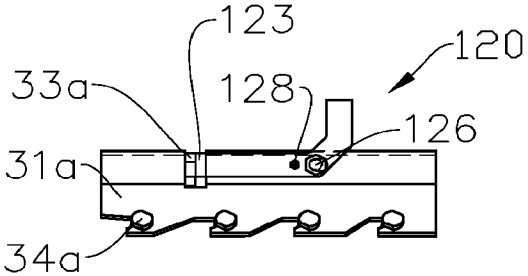
FIG. 6 is a top view of the improved anchor cable release mechanism of the present invention showing the release arm pivotally attached to the bracket body (along the cable through channel) with the anchor cable retention yoke extending into the bracket channel through the release slot in the channel.

The pivot arm 120 is through bolted to the anchor bracket 31*a* at the elbows 130 (FIG. 5B) of the L-shaped straps by bolt 126 and held in place with an alignment/retention pin 128 as shown in FIGS. 6 and 6A.

FIG. 6 is a top view of an improved anchor cable release mechanism 30*a* showing the release pivot arm 120 pivotally attached to the bracket 31*a* with the cable release yoke 123 extending into the cable through channel 27*a* through the release slot or notch 33*a*.

FIG. 6A illustrates a top view of the release mechanism 30*a* of FIG. 6 with the downstream end of the anchor cable 26*a* having a button end cap 37*a* releasably retained in place by the yoke 123.

Other embodiments of an improved cable anchor release mechanism at the downstream end of the cable anchor are shown in FIGS. 19A-19C, 20A-20B, and 21A-21B and will be discussed below.

FIG. 7A-7D illustrate how the improved anchor cable release mechanism 30*a* operates as the feeder chute 48*a* moves downstream along the W-beam rail elements 14*a* upon impact to the terminal head 50.

Figures 7A, 7B, 7C, 7D:
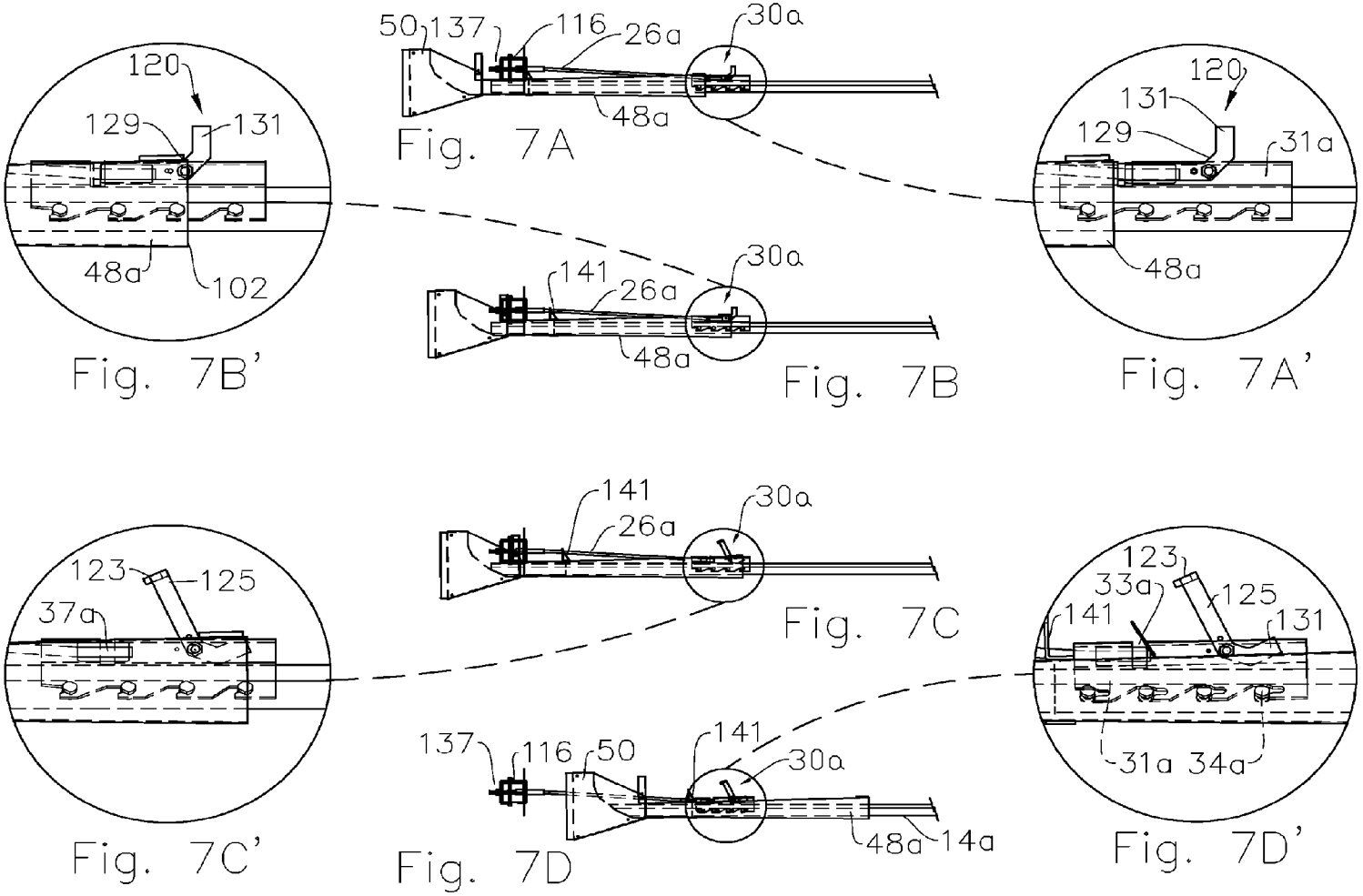
FIGS. 7A-7D illustrate in top views the sequential operation of the improved anchor cable release mechanism as the feeder chute moves downstream along the W-beam rail element upon impact of the terminal impact head.

FIG. 7A and Detail FIG. 7A' illustrate the mechanism 30*a* before a vehicular impact to the terminal head 50. The release pivot arm 120 (FIG. 7A') is a first anchorable retaining position with the long ends 125 generally horizontal and the vertical section 131 generally vertical. In this first position the button cap 37*a* on the downstream end of anchor cable 26*a* is releasably retained in the cable through channel 27*a*. The upstream end 137 of the cable 126*a* is retained in the anchor at the lower section of Post 1.

FIG. 7B illustrates a top view of the guardrail system of FIG. 7A as the impact head and feeder chute are urged downstream upon impact. FIG. 7B and Detail FIG. 7B' show that the downstream end 102 of the chute 48*a* has engaged the sloping intermediate section 129 of the release arm 120. This engagement will cause the arm 120 to pivot with the vertical end 131 rotating downstream and the long ends 129 pivoting and lifting the yoke 123 off the button cap 37*a* of the cable 26*a*.

FIG. 7C shows the further downstream movement of the terminal head and feeder chute. As seen in FIGS. 7C and Detail FIG. 7C', the yoke 123 has fully lifted out of slot 33*a*, the cable button cap 37*a* has been released and the cable 26*a* is being released at the downstream end of the cable 26*a* rather than the upstream end 137 as would occur with prior art mechanisms.

A further downstream displacement of the feeder chute and impact head is shown in FIGS. 7D and Detail 7D'. In this further movement downstream, the bracket release shoulder 141 on an upstream end of the feeder chute has engaged the upstream end of the release bracket 31*a* pushing the bracket 31*a* off of the W-beam rail element 14*a*, as would be understood from prior art U.S. Pat. No. 8,448,913. Descriptions relating to the pushing and out-of parallel alignment of the bracket described in U.S. Pat. No. 8,448,913 are incorporated herein for all purposes.

FIG. 8A-8D illustrates perspective views of the sequential operation of the improved anchor cable release mechanism 30*a* as disclosed in FIGS. 7A-7D.

Figure 8B:
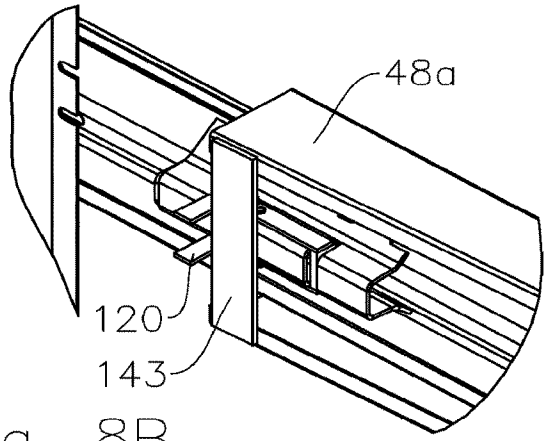
FIGS. 8A-8D are perspective views of the sequential operation of the improved anchor cable release mechanism as the feeder chute moves downstream along the W-beam rail element.
Figure 8D:
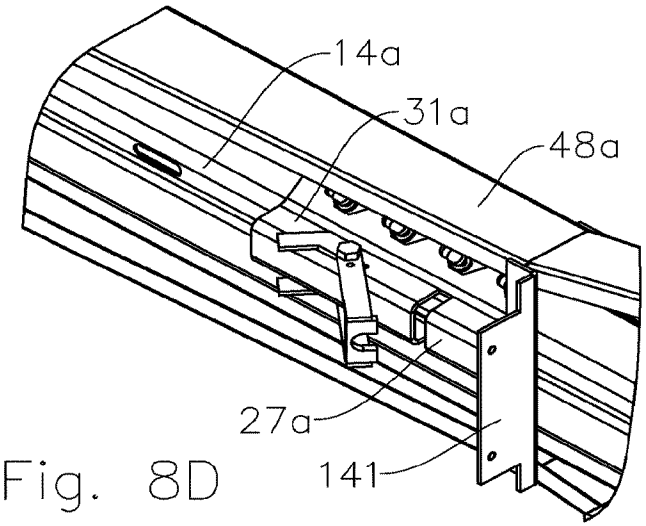
Figure 8A:
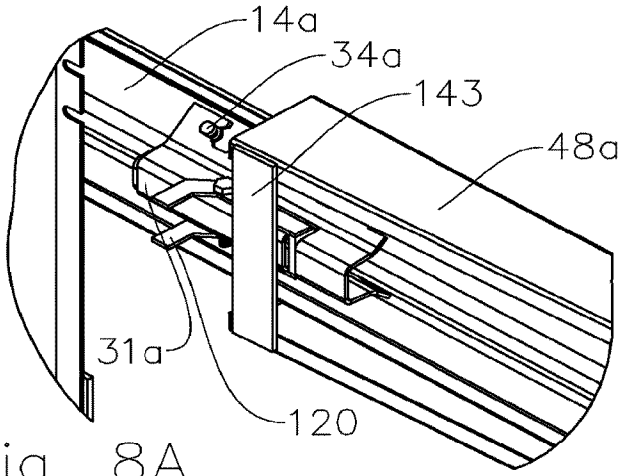

FIG. 8A is a perspective view of the guardrail system of the present invention from the non-traffic side of the guardrail. Strut 143 attached at the downstream most end of the feeder chute 48*a* is shown in a non-engaging position. The anchor cable bracket 31*a* is mounted to the W-beam rail element 14*a* by mounting bolts 34*a*. The release arm 120 is in a first position with the yoke 123 in the yoke slot 33*a* releasably retaining cable 26*a* in the bracket (Cable 26*a* is not shown for clarification purposes).

As the chute 48*a* moves downstream as shown in FIG. 8B, the strut 143 engages the sloping section 129 of the arm 120 urging the arm to pivot the yoke 123 out of the slot 33*a*.

Figure 8C:
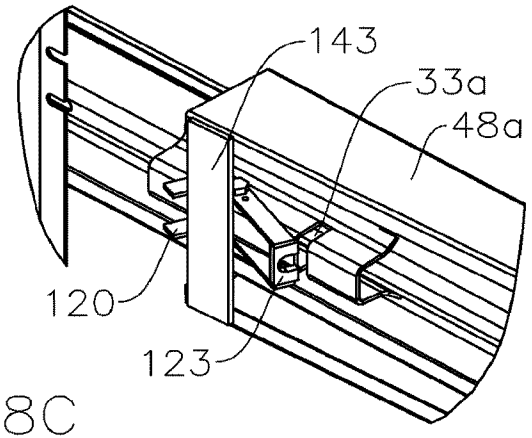
Figure 9A:
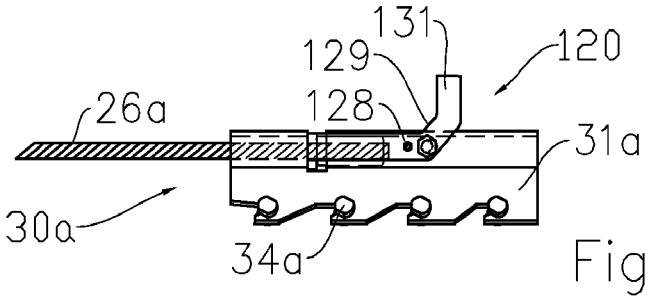
FIGS. 9A-9D are top views of the improved anchor cable release mechanism as the release arm moves from a first position (FIG. 9A) securing the anchor cable within the bracket channel through initial contact (FIG. B) to initial pivoting (FIG. 9C) with the release arm yoke lifting to final pivoting and full release of the cable (FIG. 9D) (The feeder chute is not shown for clarification purposes).
Figure 9B:
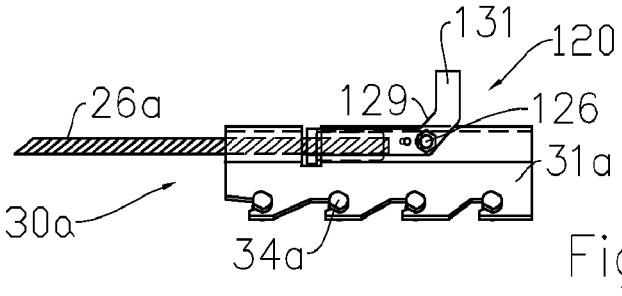
Figure 9C:
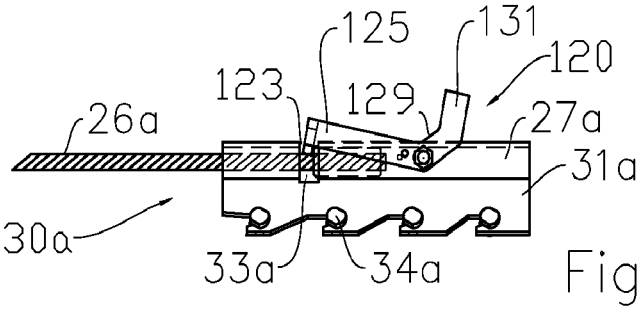
Figure 9D:
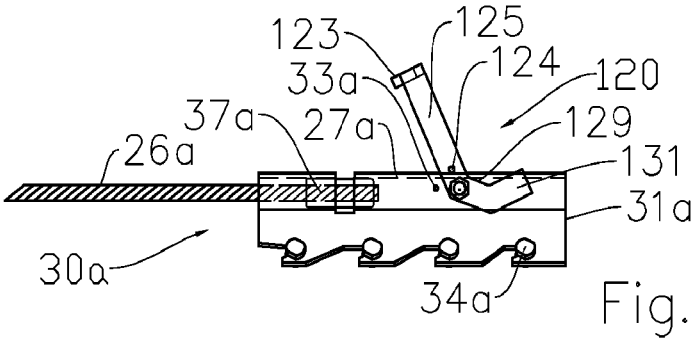

FIG. 8C illustrates how the strut 143 pushes back the arm 120 causing the yoke 123 to lift out of the slot 33*a* and release the cable 26*a* at its downstream end.

FIG. 8D shows the further downstream movement of the feeder chute 48*a* with the bracket release shoulder 141 attached to an upstream end of the feeder chute 48*a* impacting the upstream end of bracket 31*a* urging the bracket 31*a* off of the W-beam rail element 14*a* as previously described.

FIGS. 9A-9D further illustrate the operation of the improved anchor cable release mechanism 30*a* in side elevation views. Corresponding reference numerals shown in FIGS. 7A-7D; Detail FIGS. 7A'-7D' and FIGS. 8A-8D are used in FIGS. 9A-9D. As may be seen (without showing the feeder chute 48*a*) in FIGS. 9A-9D, the cable release mechanism 30*a* of the embodiment of the present invention is very different than the release mechanism of the prior art.

One major benefit of the new lever arm cable release mechanism is the separation of the impulses imparted to the impact head and in turn the impacting vehicle by first releasing the anchor cable from the bracket, and then knocking the bracket off at a much later time. With the prior art anchor cable release design, these two impulses occur within a very short period of time and sometimes the process of knocking the cable anchor bracket off occurs while the cable is still taut, resulting in potential destabilizing of the impact head and impacting vehicle. This problem is resolved by separating the two impulses with the new lever arm cable release mechanisms. Furthermore, it allows more time between initial impact with the impact head and breaking of post 1, thus further separating the impulses imparted on the vehicle.

As discussed above, an embodiment of the present invention provides an improved Post 1 having added lateral strength to accommodate side impacts just downstream of Post 1. FIG. 10 is a perspective view of the assembled Post 1 structure 116*a* of the present invention in a first aligned position. This new Post 1 (116*a*) is seen also in FIGS. 2-2A and FIGS. 7A-7D. In the prior art, when Post 1 experienced the force of a head-on impact, the post was intended to breakaway. However, the prior art post had limited lateral strength. For side impacts just downstream of Post 1, the prior art post may unintentionally breakaway. The present improved Post 1 design 116*a* shown in FIG. 10 has a unique coupling structure 205 at the joinder of upper post section 200 with lower post section 202 which provides additional lateral strength to Post 1 on lateral impacts.

Figure 10A:
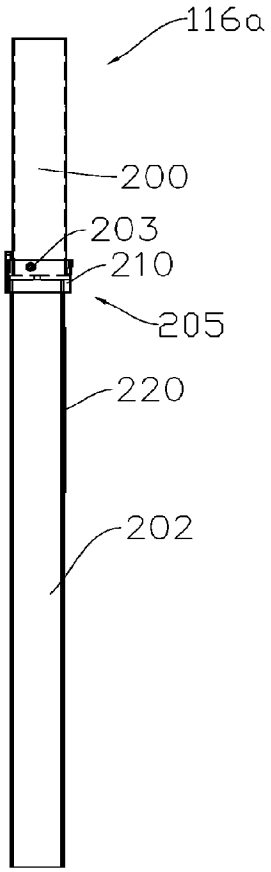
FIG. 10A is a side elevation view of the assembled Post 1 showing the upper and lower post section held together by a retainer bolt.
Figure 10:
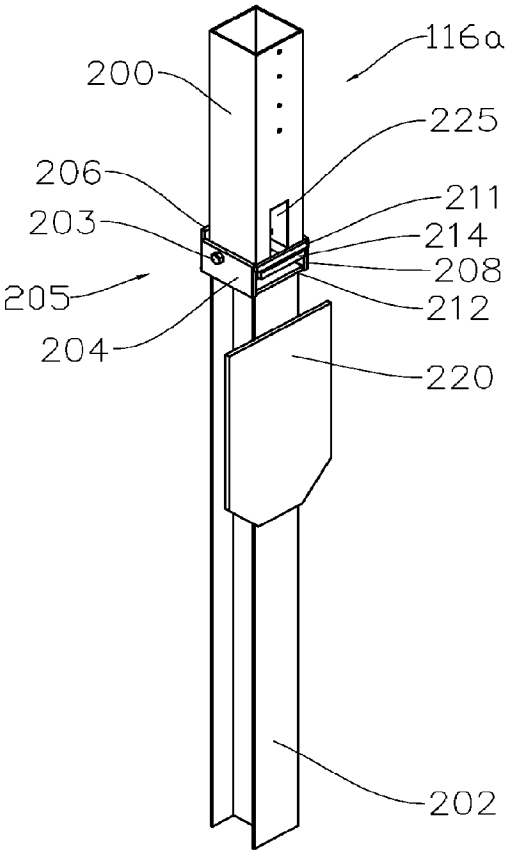
FIG. 10 is a perspective view of the improved Post 1 of the present invention in a first aligned position.

FIG. 10A illustrates a side elevation view of improved Post 1 (116*a*) in a first aligned position with upper post section 200 mounted in a retaining coupling 205 and retained on the top of lower post section 202 by through bolt 203. Retaining coupling 205 is formed by side walls 204, 208; front side wall 206; and back side wall 210.

The back side wall 210 is open except for strut 211 (FIG. 10) which extends between the side walls 204 and 208 above the base 212 of coupling 205. As will be described below, the open space between the lower edge of strut 211 and base 212 forms a coupling space 216 (FIG. 11A) for receiving and retaining the lateral support lip 214 on upper post section 200.

Figure 11A:
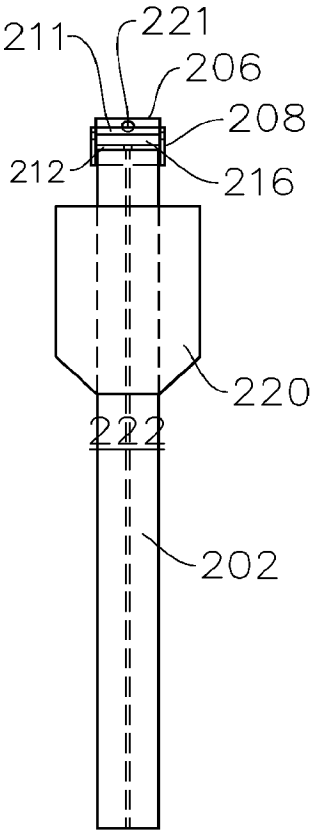
FIG. 11A is a downstream side elevation view of the lower section of the improved Post 1 shown in FIG. 11 (FIG. 11 rotated 90° clockwise).
Figure 11:
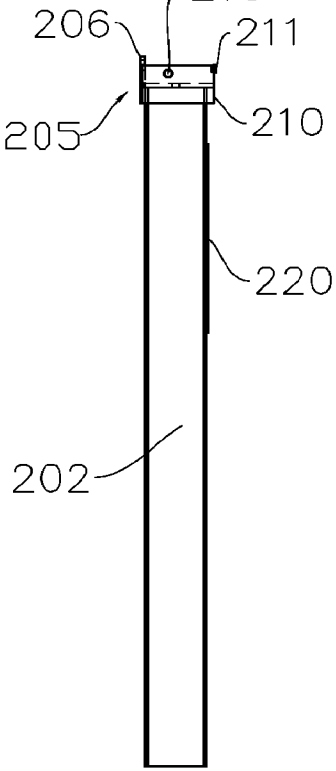
FIG. 11 is a side elevation view of the lower section of the improved Post 1.

FIG. 11 is a side elevation view of the lower section 202 of post 116*a* showing the retaining coupling 205, strut 211, front side wall 206 and back side wall 210, and bolt hole 213. FIG. 11A is a downstream side elevation view of the lower section 202 of the post 116*a* showing an anchor cable through hole 221 in front side wall 206, strut 211 extending from side wall 204 to side wall 208 above coupling base 212 thereby forming coupling space 216. A resistance plate 220 is attached to the downstream face 222 of post section 202 and provides resistance to the movement or rotation of the lower section 202 when the post 116*a* is disposed in the soil. The upper post section 200 is shown in a side elevation view in FIG. 12. Lateral support lip 214 is shown welded to the lower edge of section 200, bolt hole 215 cooperates and aligns with bolt hole 213 to receive and retain connecting bolt 203 when the post sections 200 and 202 are assembled.

Figure 12A:
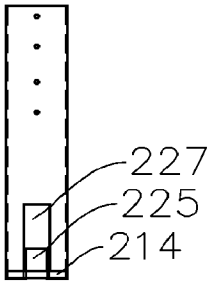
FIG. 12A is a downstream, side elevation view of the upper section of improved Post 1 shown in FIG. 12 (FIG. 12 rotated 90° clockwise).
Figure 12:
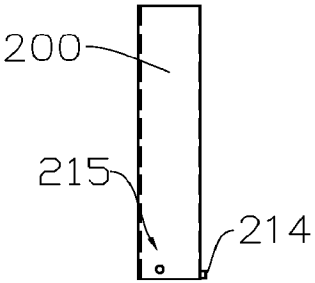
FIG. 12 is a side elevation view of the upper section of the improved Post 1.

FIG. 12A is a downstream side elevation view of the upper section of Post 116*a* shown in FIG. 12, but rotated 90° clockwise. Lateral support lip 214 is shown welded on the bottom of section 200. Cable through notches which allows anchor cable 26*a* to pass through and be secured to plate 206 on lower post section 202 are seen in FIG. 12A. Notch 225 is in the front wall of the upper post section while notch 227 is in the back wall of the upper post section.

Figure 13A:
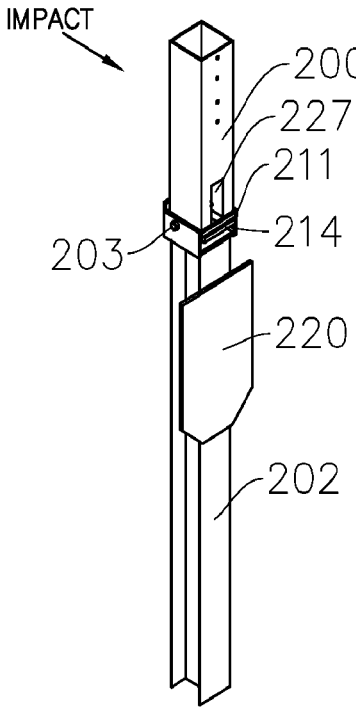
FIGS. 13A-13C illustrate the sequential movement of the upper section of Post 1 upon an end-on impact.
Figure 13B:
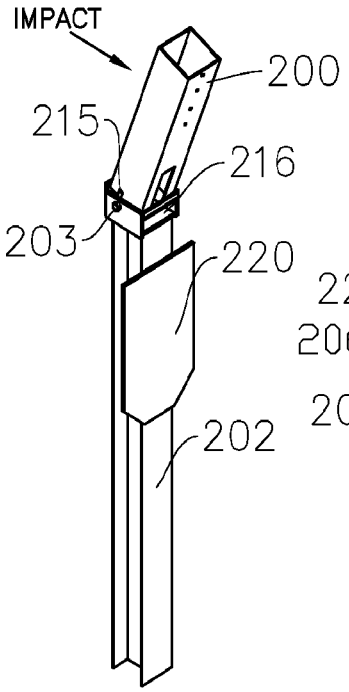
Figure 13C:
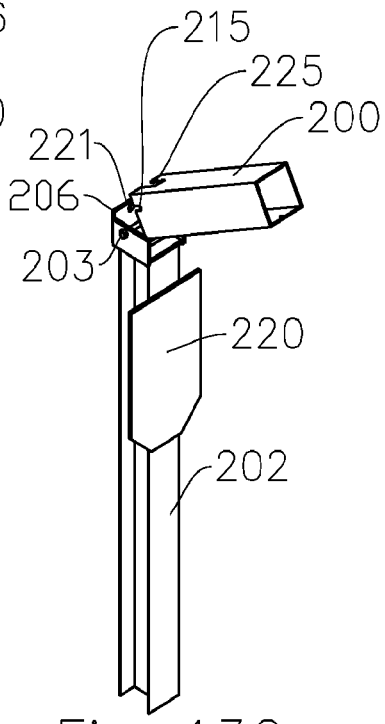
Figures 14A, 14B, 14C, 14D:
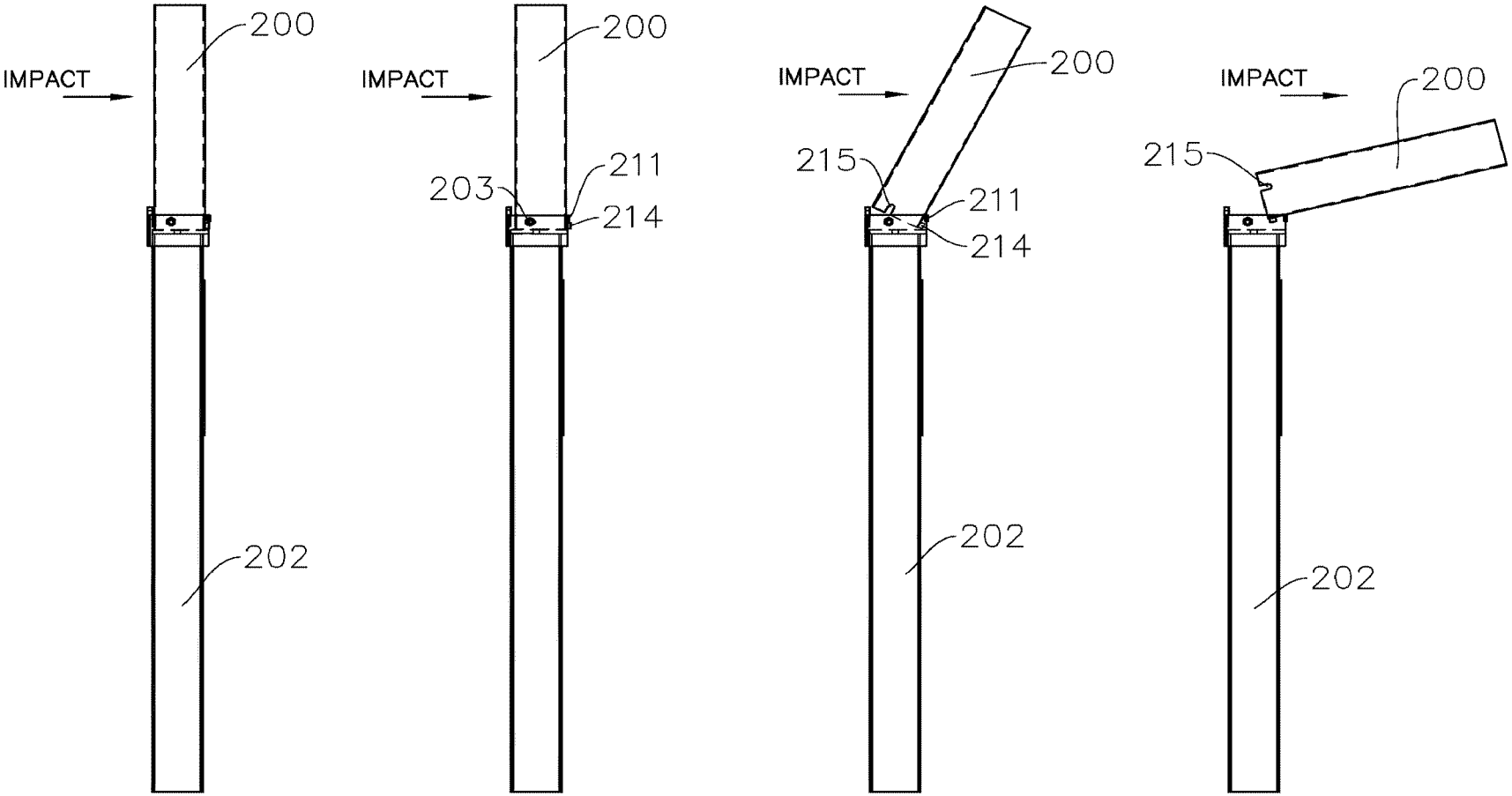
FIG. 14A-14D illustrate, in side elevation views, the movement of the upper section of Post 1 relative to the lower section upon impact of a vehicle.

FIGS. 13A-13C illustrate the sequential movement of the upper post section 200 during an end on impact. The impacting forces cause the upper post section 200 to breakaway and rotate downstream. As may be seen in FIGS. 13B and 13C, the lateral support lip 214 rotates out of coupling space 216 and section 200 is lifted free from the bolt 203 by tearing through the lower lip of the bolt hole 215. This is how the upper section 200 is broken from the lower section.

FIGS. 14A-14D show, in side elevation view, the sequential movement of the breakaway of the upper post section 200 from the lower post section 202 upon an end-on impact.

The design of the improved Post 1 (116*a*) is similar to prior art Post 1 except for the two "blocker" plates on the downstream side of the post assembly. These "blocker plates"are cooperating strut 211 and lateral support lip 214. Lateral support lip 214 is welded to the bottom of the upper post section 200 as seen in FIGS. 10, 12, and 12A. When in the first aligned, assembled position shown in FIGS. 10 and 10A, the lip 214 fits within the coupling space 216 (FIG. 11B) beneath support lip 214 and the retaining coupling base 212.

Figure 15C:
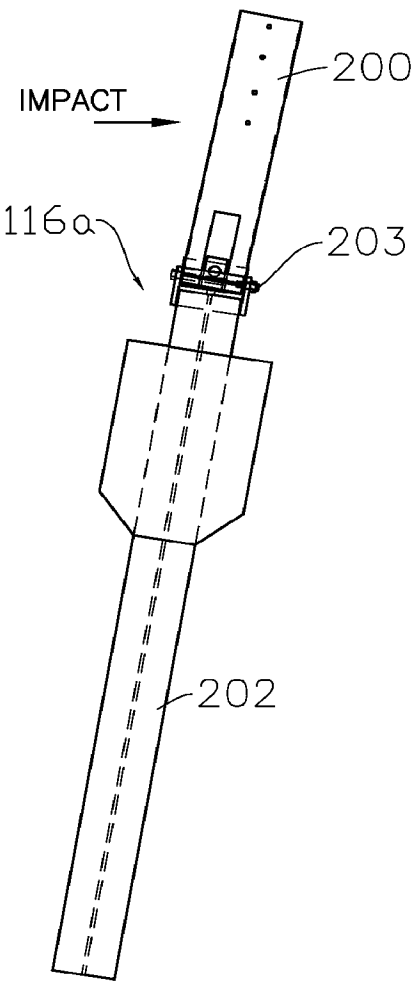
FIGS. 15A-15C illustrate the lateral strength of the improved Post 1 to side impacts at Post 1. The upper and lower sections of Post 1 remain engaged during lateral impact.
Figure 15B:
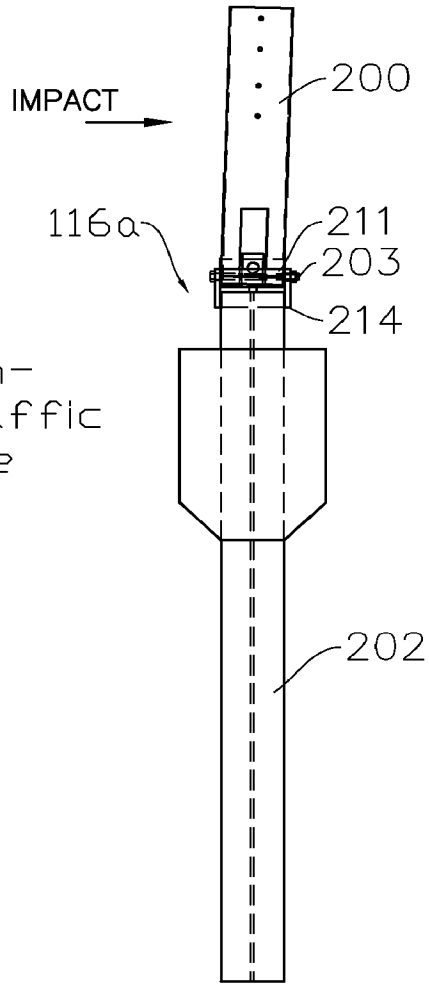
Figure 15A:
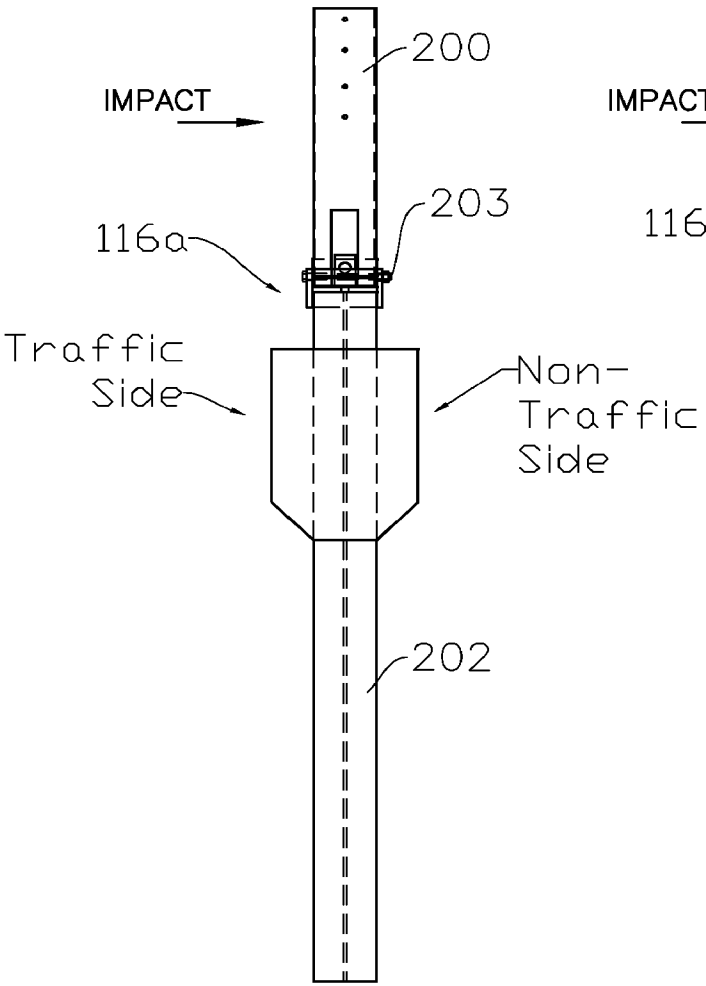

FIGS. 15A-15C illustrate in downstream, side elevation views the effect of improving lateral strength of improved post 116*a*. During a side impact, the upper post section 200 of the post 116*a* will begin to rotate laterally toward the non-traffic side of the post 116*a*. As may be seen in FIG. 15B, as the upper section 200 begins to rotate lateral support lip 214 is held in the coupling space 216 by strut 211 and resists lateral rotation of the upper section 200. In FIG. 15C it may be seen that the entire post 116*a* has rotated laterally to the non-traffic side, but the upper section 200 has not broken away. In FIG. 15C lateral loading has been transmitted to the lower section 202 and soil (not shown) through both the bolt 203 connection and the cooperation of the "blocker" plates (lip 214 and strut 211), thus greatly increasing the lateral strength of post 116*a*.

Figure 16A:
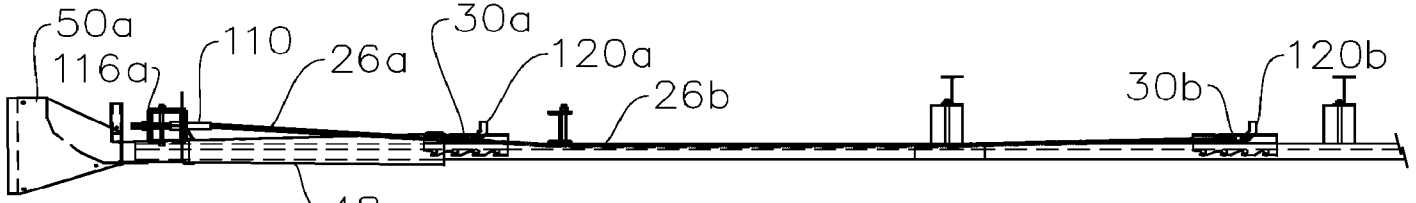
FIG. 16A shows a top view of the guardrail system of FIG. 16.
Figure 16:
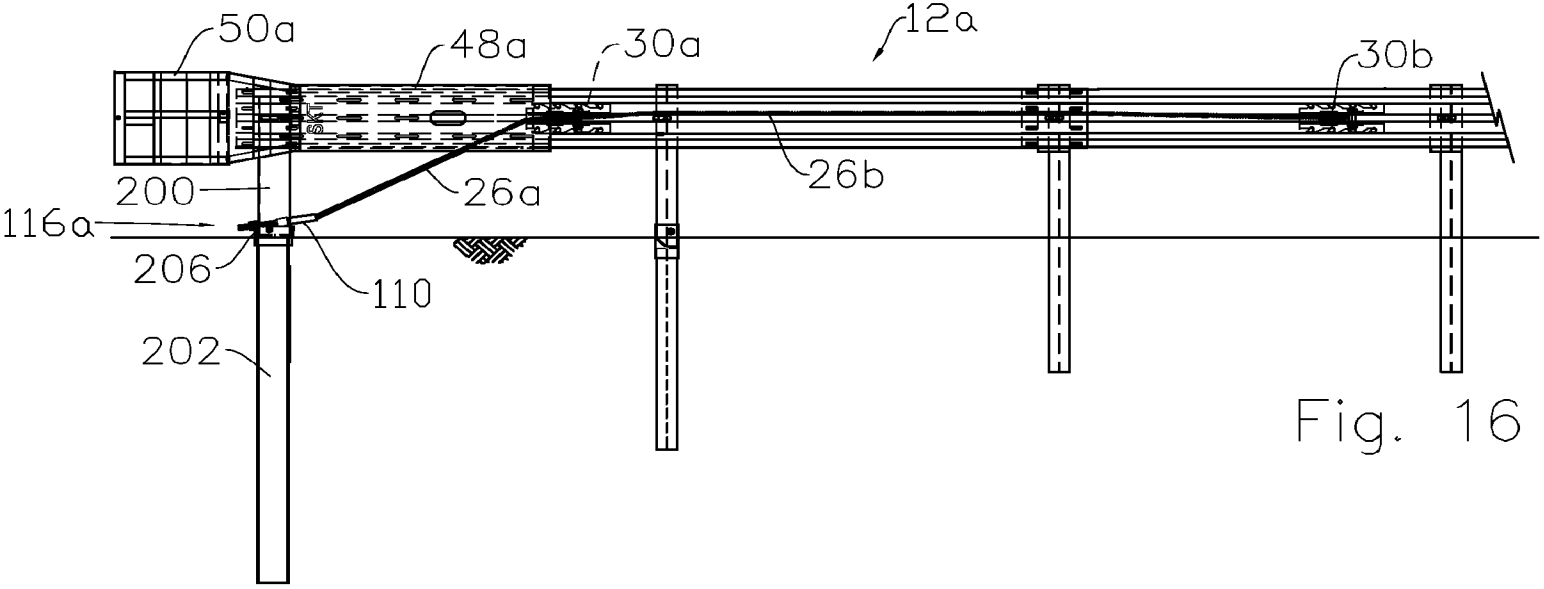
FIG. 16 is a side elevation view of a guardrail system of the present invention showing two spaced-apart anchor cable release mechanisms disposed on sections of the W-beam rail elements.

Using the improved anchor release mechanism design described above in relation to FIGS. 7A-7D; Detail FIGS. 7A'-7D'; FIGS. 8A-8D'; and FIGS. 9A-9D, it should be understood that a multiplicity of such mechanism may be used in combination to maintain tension in the W-beam rail guardrail system. FIGS. 16 and 16A illustrate an example of the use of two anchor cable release mechanisms 30*a* and 30*b* to maintain tension in the guardrail 12*a*.

In FIGS. 16 and 16A, an additional length of anchor cable 26*b* has been swagged together at a first upstream end with first cable 26*a* to span from Post 1 (116*a*), through the first anchor cable release mechanism 30*a* to the second, downstream mechanism 30*b*. The second downstream end of the additional length of anchor cable 26*b* is releasably held in the second mechanism 30*b*. The upstream end 110 of anchor cable 26*a* is attached permanently to the front side wall 206 of the lower portion 202 of post 116*a*.

Once an impacting vehicle pushes the head 50*a* downstream, it breaks away the upper post section 200, and the feeder chute 48*a* moves downstream and engages the first release lever arm 120*a* thereby disconnecting cable section 26*a* from the first cable release mechanism 30*a*. However, since cable 26*a* is swagged to cable 26*b* which is still held in place by the second cable release mechanism 30*b*, tension in the anchor cable 26*a* and 26*b* and the W-beam rail 12*a* is maintained.

The feeder chute 48*a* continues downstream and pushes the first cable release bracket 30*a* from the upstream W-beam rail section 12*a*. When the feeder chute 48*a* reaches the second cable release mechanism 30*b*, it engages the second release arm 120*b*, and the entire anchor cable (26*a* swagged to 26*b*) is released at the downstream end at mechanism 30*b*. The tension in the W-beam rail 12*a* is maintained through the release of subsequent cable release mechanisms thereby reducing the propensity for W-beam rails to buckle and form elbows adversely effecting the operation of the guardrail system and the safety of the impacting vehicle.

Figure 17A:
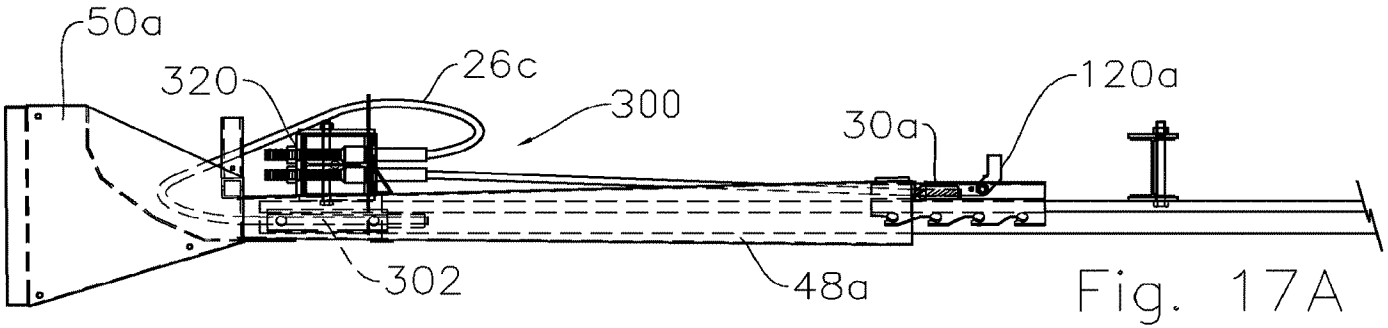
FIG. 17A is a top view of the guardrail system of FIG. 17.
Figure 17:
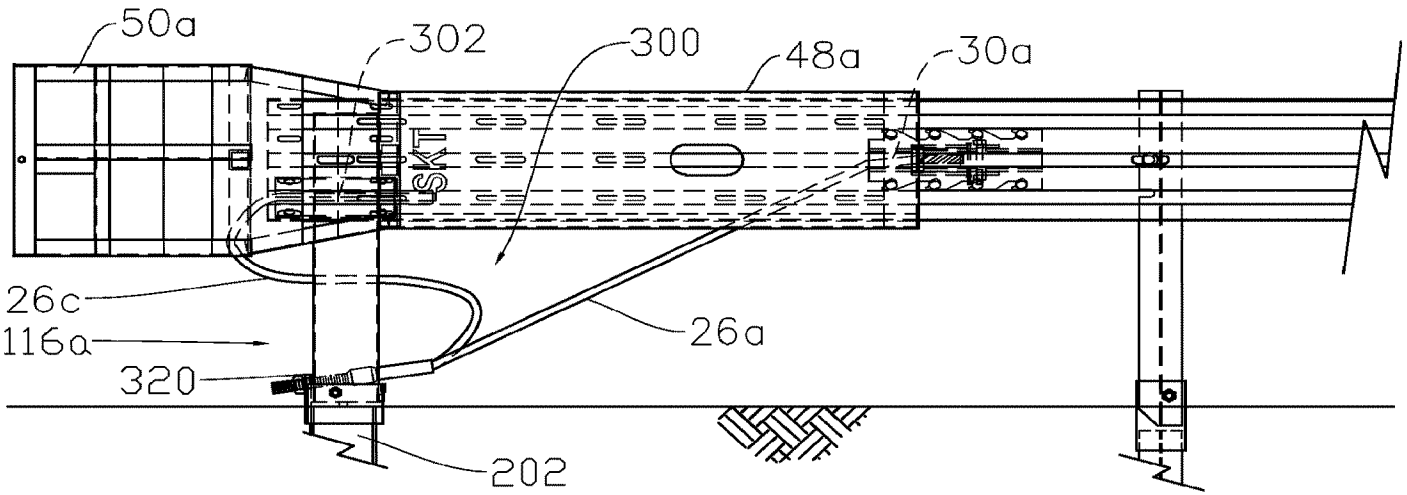
FIG. 17 is a side elevation view of a guardrail system of the present invention showing a supplement anchor cable attached to the anchor post on Post 1 with the supplemental cable passing through the impact terminal head and attached to the upstream end of the W-beam rail element in the feeder chute.

In an embodiment of the present invention shown in FIGS. 17; 17A; 18; and 18A, a supplemental cable anchor mechanism 300 is provided to maintain tension in the W-beam rail after release of the primary anchor cable 26*a*. FIGS. 17 and 17A illustrate a supplemental cable anchor mechanism 300 with anchor cable 26*c* attached at an upstream end to the same front side plate 320 (attached to the lower post section Post 1 (116*a*)) as the primary anchor cable 26*a*.

A front side plate 320 (FIG. 17A) with two drilled holes allows for the attachment of both anchor cables 26*a* and 26*c* to the same anchor post at post 116*a*. Note that the front side plate 320 is similar to the front side plate 206 in FIGS. 2, 2A, 11, and 16 which has a single drilled hole for anchor cable 26*a*

Figure 18A:
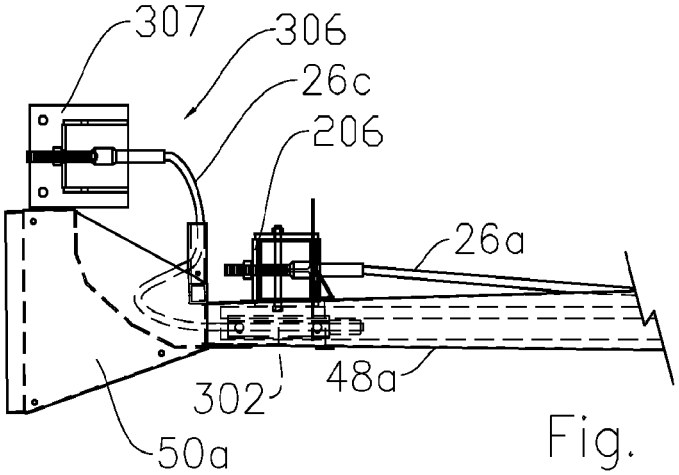
FIG. 18A is a top view of the guardrail system of FIG. 18.
Figure 18:
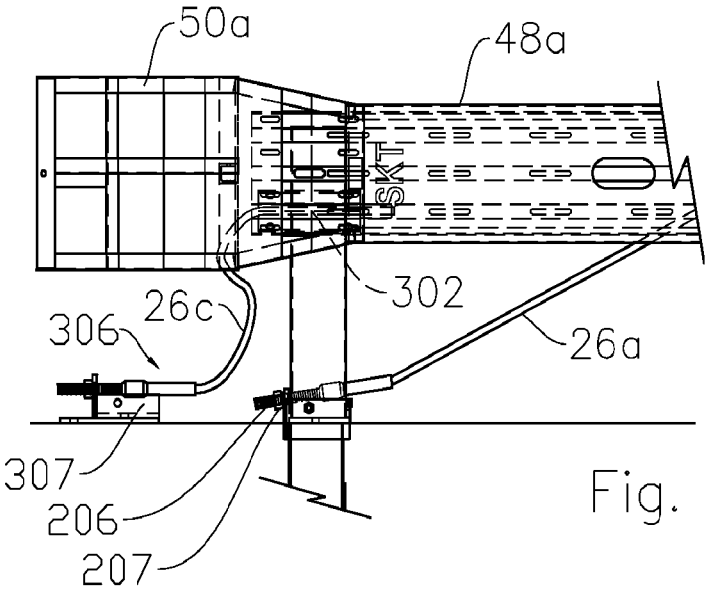
FIG. 18 illustrates side elevation view of a guardrail system of the present invention with the anchor post disposed upstream of Post 1 rather than on Post 1 as shown in FIG. 17.

Alternatively, as seen in FIGS. 18 and 18A, an additional and separate cable anchor mechanism 306 may be installed upstream of post 116*a*. The anchor 306 may consist of a lower post portion 202, similar to that of post 116*a*, or a cable anchor bracket 307 as shown in FIGS. 18 and 18A. The supplemental anchor cable 26*c* extends through the impact head 50*a* and the downstream end of the cable 26*c* is retained by a bracket 302 bolted to the upstream end of the W-beam rail element.

It should be understood that sufficient slack is provided in supplemental cable 26*c* so that the cable is not tensioned initially after the primary anchor cable 26*a* is released from the release mechanism 30*a* attached to the downstream W-beam rail. As the impact head 50*a* is pushed further downstream by the impacting vehicle, the slack in the cable 26*c* is taken up and the supplemental cable 26*c* becomes taut at which time the W-beam rail is again under tension. This tension is maintained until the supplemental cable 26*c* is released from the W-beam bracket 302 attached to the upstream end of the W-beam rail. This supplemental anchor system in effect lengthens the time the W-beam rail is under tension, allowing the impact head 50*a* to travel further downstream before tension in the W-beam rail is fully released.

In an end-on impact, the primary anchor cable 26*a* would first be released as the feeder chute 48*a* impacts the release arm 120*a*. Tension in the W-beam rail would be released momentarily until the slack in the supplemental anchor cable 26*c* is taken up and the supplemental cable 26*c* becomes taut.

Turning now to FIGS. 19A-19C, 20A-20B, and 21A-21B, other embodiments of an improved cable anchor release mechanism at the downstream end of the cable anchor are disclosed.

Figure 19C:
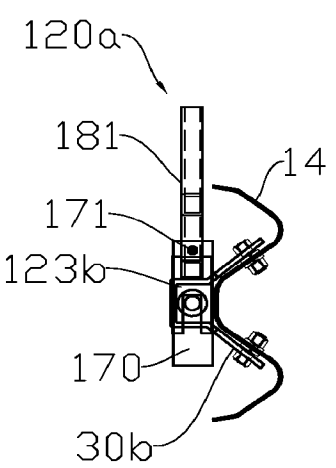
FIG. 19C is an end view of the mechanism of Figl9A mounted to non-traffic side of the W-beam rail element
Figure 19A:
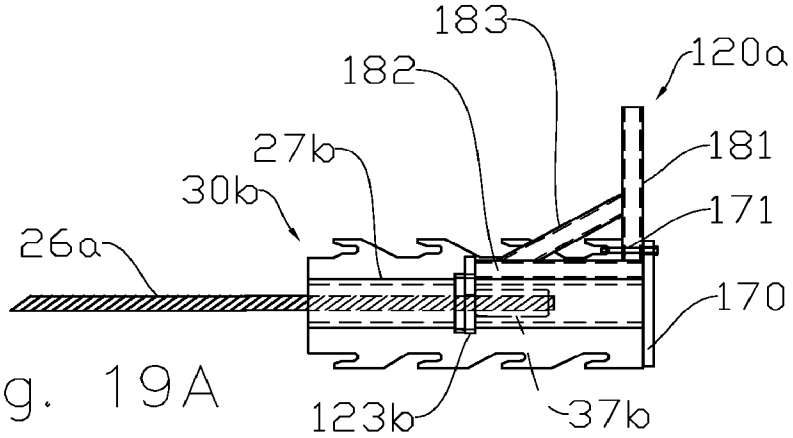
FIG. 19A is a side elevation view of an alternative embodiment of an improved anchor cable release mechanism of the present invention showing a pivot arm pivotally attached to the bracket body
Figure 19B:
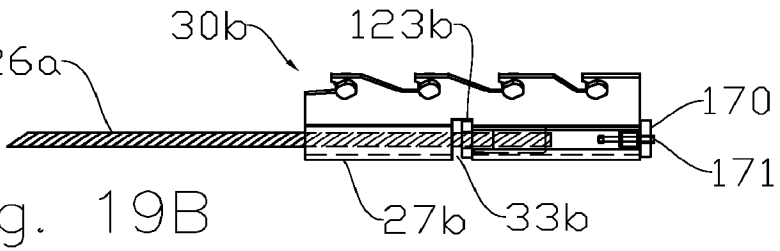
FIG. 19B is a top view of the embodiment of FIG. 19A partially showing the mechanism with mounting bolts for attaching the mechanism to the W-beam rail element (not shown)

FIGS. 19A-19C show an embodiment similar to the improved cable anchor release mechanism described in FIGS. 3 through 9. The mechanism consists of: a yoke slot 33*b* in the anchor cable release bracket 30*b*, a pivot arm 120*a*, and an end plate 170 welded to the downstream end of the channel 27*b* of the cable release bracket 30*b*. The pivot arm 120*a* is fabricated from steel tubing, with a vertical arm 181 welded to the downstream end of a horizontal member 182, and reinforced with a diagonal brace 183. A cable release yoke 123*b* is welded to the upstream end of the horizontal member 182. A bolt 171 is used to hold the pivot arm 120*a* to the end plate 170, but not firmly attached, i.e., the length of the bolt is considerably longer than the combined thickness of the vertical arm 181 of the pivot arm and the end plate 170. The anchor cable 26*a* passes through the channel 27*b* and the cable button cap 37*b* is held in place by the cable release yoke 123*b*.

In an end-on impact, the impact head and feeder chute are urged downstream. The downstream end 102 of the chute 48*a* will engage the vertical arm 181 of the pivot arm 120*a*. The engagement will cause the pivot arm to rotate about the bolt 171 attachment to the end plate 170. As the pivot arm 120*a* rotates, the cable release yoke 123*b* is lifted off the button cap 37*b* of the cable 26*b* and release the anchor cable.

Figure 20B:
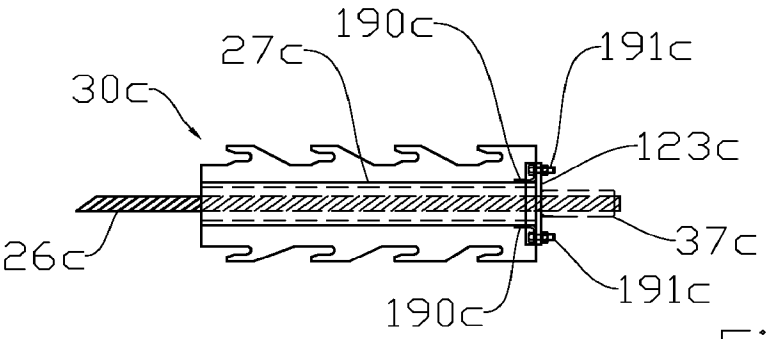
FIG. 20B is a side elevation view of the embodiment of FIG. 20A without showing the mounting bolts.
Figure 20A:
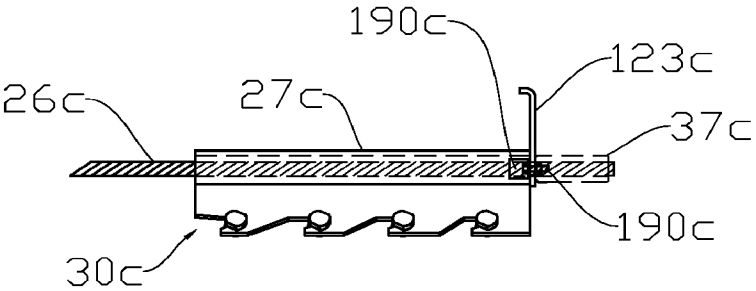
FIG. 20A is a top view of another alternative embodiment of an improved anchor cable release mechanism of the present invention with mounting bolts for attaching the mechanism to the W-beam rail element.

Another embodiment of an improved cable anchor release mechanism is shown in FIGS. 20A-20B. Two angle tabs 190*c* are welded to the downstream end of the channel 27*c* of the anchor cable release bracket 30*c*, one on each side of the channel. A cable release yoke 123*c* is attached to the two tabs 190*c* with two bolts 191*c*. The anchor cable 26*c* passes through the channel 27*c* and the cable button cap 37*c* is held in place by the cable release yoke 123*c*.

In an end-on impact, the impact head and feeder chute are urged downstream. The downstream end 102 of the chute 48*a* will engage the cable release yoke 123*c*. The engagement will cause the two bolts 191*c* holding the cable release yoke 123*c* to the tabs 190*c* to fail or for the welds on the tables 190*c* to fail, thus releasing the yoke. The yoke will then rotate and lift off the button cap 37*c* of the cable 26*c* and release anchor cable.

Figure 21B:
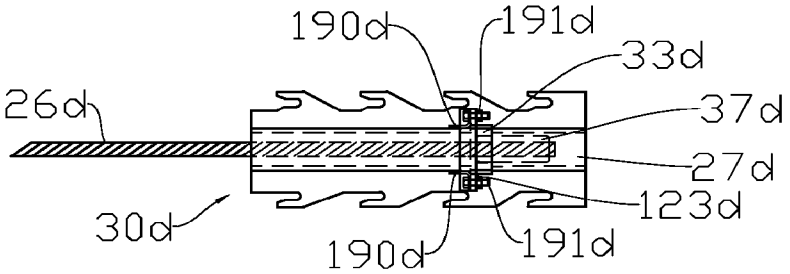
FIG. 21B shows a side elevation view of the embodiment of FIG. 21A without showing the mounting bolts.
Figure 21A:
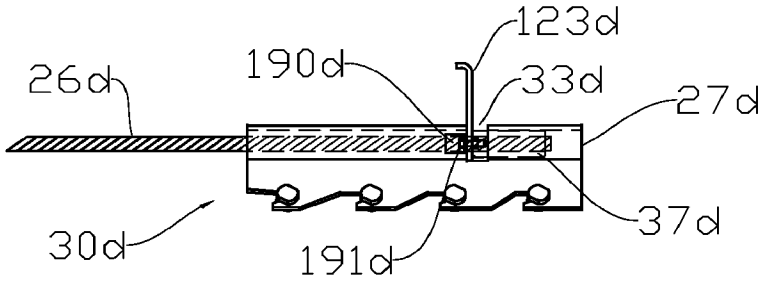
FIG. 21A illustrates a top view of yet another alternative embodiment of an improved anchor cable release mechanism of the present invention with mounting bolts for attaching the mechanism to the W-beam rail element.

In yet another embodiment shown in FIGS. 21A-21B, a yoke slot 33*d* is provided in channel 27*d* for the cable release yoke 123*d*. The two angle tabs 190*d* are welded to the channel 27*d* just upstream of the yoke slot 33*d*. The cable release yoke 123*d* is attached to the two tabs 190*d* with two bolts 191*d*. The anchor cable 26*d* passes through the channel 27*d* and the cable button cap 37*d* is held in place by the cable release yoke 123*d*.

The function of the cable release mechanism is similar to the mechanism previously described under FIGS. 20A-20B. Note that the placement of the yoke slot 33*d* along the length of the channel 27*d* may be varied to control the time at which the cable release yoke will be engaged by the downstream end 102 of the chute 48*a*.

The embodiments described herein are some examples of the current invention. Various modifications and changes of the current invention will be apparent to persons of ordinary skill in the art. Among other things, any feature described for one embodiment may be used in any other embodiment. The scope of the invention is defined by the attached claims and other claims to be drawn to this invention, considering the doctrine of equivalents, and is not limited to the specific examples described herein.

What is claimed is:

1. A highway crash attenuation system comprising:

W-beam rail elements attached to a plurality of vertical posts;

an impact terminal having a feeder chute for guiding one or more of said W-beam rail elements through said impact terminal;

an anchor cable extending from a first breakaway post to an anchor cable release mechanism releasably attached to at least one of said W-beam rail elements downstream of said first breakaway post, said first breakaway post comprising:

an upper post section and a lower post section, said upper post section having a lateral support lip extending along a lower edge of a downstream face of said upper post section and having first through holes in opposing lateral sides of said upper post section, said lateral support lip cooperating with a lower edge of a strut disposed on a downstream face of said lower post section between opposing lateral sides of said lower post section and through holes in opposing lateral sides of said lower post section to releasably retain said upper and lower post sections in a first vertically aligned position when a mounting bolt is extended through said first and second through holes in said lateral sides of said upper and lower post sections prior to vehicular impact with said first breakaway post.

2. The highway crash attenuation system of claim 1 further comprising:

a cable anchor plate attached to an upstream face of said lower post section, said plate having a through hole through which said anchor cable is adapted to pass and be retained therein by a locking nut affixed to an upstream most end of said anchor cable.

3. The highway crash attenuation system of claim 2 further comprising:

wherein said upstream most end of said anchor cable remains retained by said cable anchor plate after vehicular impact separating said upper post section from said lower post section.

4. The highway crash attenuation system of claim 1 further comprising a supplemental cable anchor system for maintaining tension on said W-beam rail element after said first anchor cable is released from said anchor cable release mechanism.

5. The highway crash attenuation system of claim 4 wherein said supplemental cable anchor system has a second anchor member upstream from said first breakaway post anchor, said system having a second anchor cable extending from said second anchor member to a bracket affixed to one of said W-beam rail elements.

6. The highway crash attenuation system of claim 1 further comprising:

an additional length of anchor cable attached at an upstream end to said downstream end of said first length of cable and attached at a second downstream end to a second cable release bracket releasably attached to a second W-beam rail element, said second cable release bracket having a cable through channel for receiving and releasably retaining said second downstream end of said additional length of anchor cable, said second cable release bracket having a second release arm attached to said second bracket, said second arm pivotable from a first cable retaining position to a second cable release position upon impact of said second arm with said downstream end of said feeder chute.

7. The highway crash attenuation system of claim 1 further comprising:

an impact shield extending along a traffic-facing side of said chute from an upstream-most end of said chute to a downstream-most end of said chute, said impact shield closing said traffic-facing side of said chute to prevent an impacting vehicle from wedging into said chute or said one or more W-beam rail elements from buckling out said traffic-forcing side of said chute.

* * * * *